United States Patent [19]

Bolton et al.

[11] Patent Number: 4,753,711

[45] Date of Patent: Jun. 28, 1988

[54] SURGE CONTROL SYSTEM AND METHOD FOR DEWATERING PRESS FELTS

[75] Inventors: Joseph A. Bolton; Phillip L. Adamczyk, both of Glens Falls, N.Y.

[73] Assignee: Albany International Corp., Menands, N.Y.

[21] Appl. No.: 906,630

[22] Filed: Sep. 10, 1986

Related U.S. Application Data

[63] Continuation of Ser. No. 665,026, Oct. 26, 1984, abandoned, which is a continuation-in-part of Ser. No. 575,447, Jan. 31, 1984, Pat. No. 4,551,202.

[51] Int. Cl.[4] ..... D21F 1/48; D21F 11/02

[52] U.S. Cl. ..... 162/198; 162/199; 162/252; 162/263; 162/274; 415/30; 415/36

[58] Field of Search ..... 162/198, 199, 252, 262, 162/263, 274, 253, 259, 217, 317; 415/30, 36

[56] References Cited

U.S. PATENT DOCUMENTS

| | | | |
|---|---|---|---|
| 3,817,651 | 6/1974 | Law et al. | 415/36 |
| 3,876,326 | 4/1975 | Weitz | 415/30 |
| 3,986,788 | 10/1976 | Rossi | 415/30 |
| 4,146,425 | 3/1979 | Gulzeit | 162/252 |
| 4,308,077 | 12/1981 | Bolton | 162/199 |
| 4,398,996 | 8/1983 | Duncan et al. | 162/198 |
| 4,551,202 | 11/1985 | Bolton et al. | 162/274 |

OTHER PUBLICATIONS

Lavigne, "Instrumentation Applications", Miller Freeman Publications, S-F, 1979, pp. 208-209.

Hoffman-Centrifugal Blowers & Exhausters, "Hoffman Air & Filtration Systems", N.Y., CBE-378.

*Primary Examiner*—Steve Alvo

*Attorney, Agent, or Firm*—Kane, Dalsimer, Sullivan, Kurucz, Levy, Eisele and Richard

[57] ABSTRACT

A surge control system for dewatering press felts on a papermaking machine which includes a suction pipe, a variable speed drive motor, a centrifugal exhauster driven by the variable speed drive motor and connected to the suction pipe to provide vacuum to a felt passing over a slot for dewatering thereof. A surge valve is provided and is opened to admit air to the centrifugal exhauster so as to prevent surge when the centrifugal exhauster is operating at a predetermined level at which the centrifugal exhauster will surge.

5 Claims, 2 Drawing Sheets

SURGE CONTROL SYSTEM AND METHOD FOR DEWATERING PRESS FELTS

This application is a continuation of U.S. application Ser. No. 665,026, filed Oct. 26, 1984 (now abandoned), which was a continuation-in-part of U.S. application Ser. No. 575,447, filed Jan. 31, 1984, U.S. Pat. No. 4,551,202, which issued on Nov. 5, 1985.

FIELD OF THE INVENTION

The present invention relates to a surge control system, in particular for use in a variable speed electric drive for a applications.

BACKGROUND OF THE INVENTION

It is well known in the papermaking industries to use vacuum or suction pipe systems in dewatering. Such systems often utilize suction pipes coupled to elongated suction slots over which a felt passes causing the dewatering thereof. In systems of this type, a variety of devices exist to create the vacuum necessary for dewatering. For example, liquid ring pumps, positive displacement pumps and centrifugal exhausters or blowers. While many circumstances and operating parameters dictate what type device in this regard is best suited for a particular application, a common desire in which every type vacuum pump is selected is that it be efficiently incorporated and utilized in the system.

In this regard, generally the vacuum pumps are sized for maximum demand vacuum conditions in the suction pipe when the felt is new. The vacuum pump will normally run at its maximum speed with a new felt. As a felt fabric fills voids during its life, it becomes less permeable requiring a higher vacuum level for dewatering. However, with the decreased felt permeability and since the vacuum pump is a constant volume unit, the vacuum level will automatically increase.

Heretofore, many systems have been devised to take advantage of increasing vacuum conditions and to effect cost and energy saving as a result thereof. See i.e., U.S. Pat. Nos. 4,308,077, issued Dec. 29, 1981; 4,329,201, issued May 11, 1982; and 4,398,996, issued June 19, 1981. For example, in the variable vacuum liquid ring pump having constant flow, as set forth in U.S. Pat. No. 4,398,996, a variable speed drive motor is provided and is responsive to an increase in the vacuum level in the suction pipe. The motor is activated to slow down the vacuum pump as the felt permeability decreases, thereby retaining the desired level in the suction pipe. The lower pump speed results in lower drive horsepower and accordingly a savings in power, while retaining the desired vacuum level in the suction pipe.

While such an arrangement has proven satisfactory in certain applications, it is desired to provide for yet further efficiency and energy savings in a dewatering system, particularly one that utilizes a centrifugal exhauster or blower as compared to a positive displacement unit.

In copending U.S. application Ser. No. 575,447, filed Jan. 31, 1984, now U.S. Pat. No. 4,551,202, commonly assigned herein, there is a centrifugal exhauster which provides improved efficiency. The speed of the exhauster as the permeabilities of the felt decreases is automatically regulated. A variable speed motor drive for the exhauster of the type commonly found in the market place is utilized. The maximum speed of the motor can be limited by either the maximum current to the motor and/or maximum frequency setting. In the case of a variable frequency drive motor for example, the maximum speed and current may be automatically controlled by using a feedback loop.

In all exhauster arrangements of which the foregoing is no exception, the occurrence of surge can have a serious and often damaging effect on the system. While many different type surge controls are available, it would be desirable to have an automatic surge control that is particularly effective in the situation using a variable speed drive with a centrifugal exhauster in papermaking applications, since there is no specific signal that can be used to sense surge because the surge points change with speed.

SUMMARY OF THE INVENTION

It is therefor a principal object of the invention to provide for an automatic surge control system for a variable speed drive centrifugal exhauster used in dewatering applications.

It is another object of the invention to provide for such a surge control which is relatively simple and inexpensive and particularly useful in such circumstances.

The present invention provides for an automatic surge control system for use with a variable speed drive centrifugal exhauster. The exhauster is used in dewatering applications and the speed of the exhauster automatically increases as the air flow demand (i.e., at the suction slot etc.,) decreases due to a change in felt permeability. If for example, the suction slot was completely shut off, the exhauster would automatically speed up to its maximum speed. In such a system, it is determined that the exhauster cannot go into surge until after it reaches its maximum speed setting. Therefor surge need only be controlled at the maximum speed of the exhauster.

When the exhauster is operating at its maximum speed, the power it demands becomes less as the air flow decreases. To prevent damage due to surging, a control senses when the exhauster is running at maximum speed and when the power (hp), current draw (amp) or frequency drops below a predetermined amount. Thereupon, the control panel causes a surge valve to open to admit air to the exhauster to prevent further reduction of air flow, thus preventing the exhauster from going into surge.

BRIEF DESCRIPTION OF THE DRAWINGS

Thus by the aforenoted invention, its objects and advantages will be realized, the description of which should be taken in conjunction with the drawings, wherein.

DETAILED DESCRIPTION OF THE PREFERRED EMBODIMENT

Figure 1:
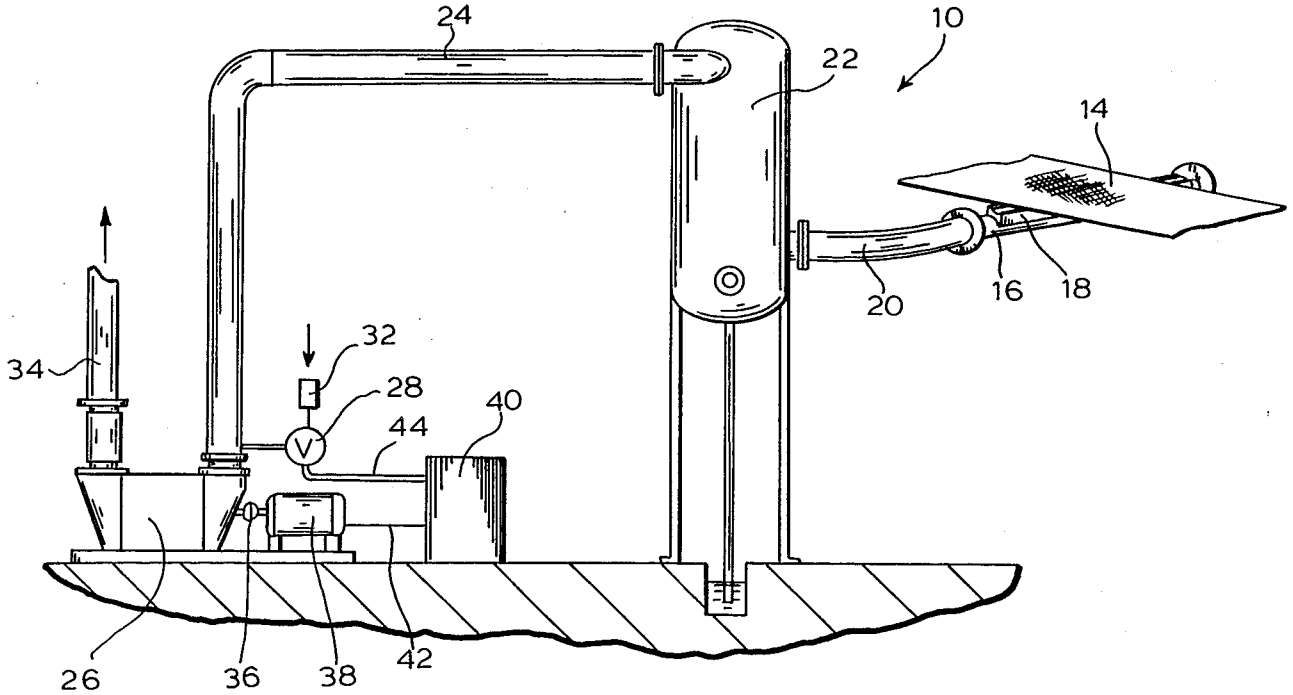
FIG. 1 is a schematic view of the vacuum control system as part of a section of a papermaking machine, incorporating the teachings of the present invention.

The depicted portion 10 is of a well known type of papermaking machine which utilizes one or more suction pipes 12 for dewatering a press felt 14 or similar fabric. The use of several suction pipes is discussed in U.S. Pat. No. 4,329,201. This is a common arrangement at the press section of the papermaking machine.

The typical suction pipes 12 include a hollow conduit 16 with a slot 18 forming an opening in its upper end over which the felt or fabric passes. An exit conduit 20 passes to a conventional type of liquid and gas separator 22. The separator 22 has a bottom exit for passage of separated liquid into a seal pit through a drop leg. The separator 22 is in turn connected by conduit 24 to a vacuum pump 26, which is a centrifugal exhauster type. Such exhauster may be of the type manufactured by Hoffman Air & Filtration Systems, a division of Clarkson Industries, Inc., P. 0. Box 214, Eastwood Station, Syracuse, N.Y. 13206. For general background material on exhausters see Publication CBE-378 entitled "Centrifugal Blowers and Exhausters" put out by the aforenoted company.

Typical in such systems, a relief or surge 28 valve is positioned between the separator 22 and the exhauster 26 for vacuum and surge release purposes when needed. Silencers 32 and 34 are also provided.

A conventional drive shaft 36 interconnects a variable speed drive means 38 with the exhauster 26 to adjust and drive it at a chosen variety of speeds as is hereinafter discussed.

Note that the drive means 38 is a variable speed drive AC motor and may be of the type manufactured for example by Reliance Electric, 24703 Eucled Avenue, Cleveland, Ohio 44117 (A-C VS Drives; Duty Master-XE; AC Motors; and Max Pak plus); Toshiba Corporation 13-12 Mita 3 chrome, Minato-ku, Tokyo, Japan (MF Pack); Toshiba/Houston International Corporation, 13131 West Little York Road, Houston, Tex. 77041 (ESP-130 series); Parametics, Orange, Conn.

The drive means 38 is coupled to a conventional control panel 40 via connection 42 which may be electrical wiring etc. The control panel 40 is coupled through connection 44 to surge valve 28 which in turn is coupled to conduit 24.

As noted, air flow through a felt decreases with age. Heretofore, in a positive displacement unit, by reducing the speed of the vacuum pump with decreasing felt permeabilities provided an advantageous way to save drive power since its power requirement was a function of pump speed. In typical variable speed drives, they are normally set up to run at a maximum speed and then as the demand decreases, its speed automatically slows down.

With a centrifugal exhauster, such a method of operation is not desirable since if the speed of the exhauster is decreased, the vacuum level decreases instead of remaining constant as a positive displacement unit would.

Rather than slowing the speed of the exhauster down, the variable speed motor 38 speeds up as the felt permeability decreases thereby producing a higher vacuum at the suction pipe. Since the air flow through the felt is less, a higher vacuum at a lower air flow is possible by speeding up the exhauster while maintaining the same torque or drive power. The system as noted in the aforementioned patent application allows the exhauster to run at a variable speed to meet the required vacuum at the suction pipe to dewater a felt as it goes from new to old rather than throttling the air flow by turning down a valve as was done heretofore with constant speed exhausters. Also, such a drive system would allow for the automatic adjustment of the exhauster during dewatering of multigrade webs, i.e., light webs at slower speeds; heavier webs at higher speeds.

When an AC motor is utilized in such a system, the speed of the motor can be varied by varying the AC frequency delivered to the motor. This is a standard feature in many of the type models of AC motors aforenoted.

The operation of the drive motor 38 may be automatically controlled using a feedback loop arrangement regulating the frequency and/or current at the desired level. The maximum speed of the motor is limited to prevent overloading by the maximum current to it or maximum speed of frequency setting.

As aforenoted, felt fabric fills its voids and becomes less permeable (scfm flow decreases) with age, causing the vacuum level required for dewatering to rise. With a constant flow, variable vacuum liquid ring style pump, the horsepower increases as the vacuum level increases over the life of the felt fabric. However, with a centrifugal exhauster, as the air flow decreases through the fabric over its life, the horsepower decreases.

Figure 2:
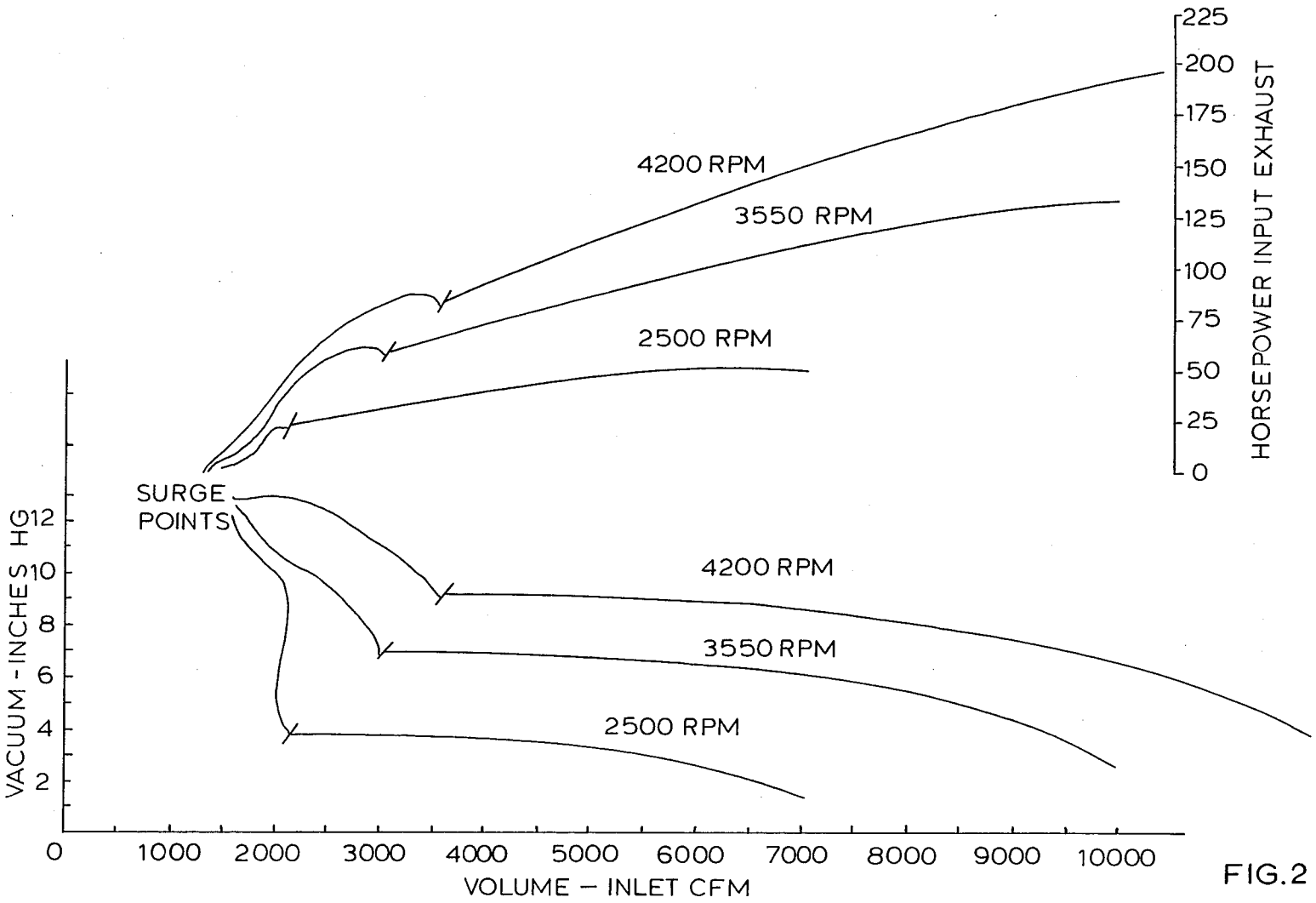
FIG. 2 is a representative performance curve for a particular variable speed centrifugal exhauster.

With the variable speed drive arrangement, the speed of the exhauster is automatically increases as the air flow demand decreases. FIG. 2 depicts the performance curve for a variable speed exhauster. As the speed of the exhauster varies so does the surge points. Since the horsepower (hp) at the surge point varies for the different rpms as shown, a monitoring thereof in and of itself is insufficient since there would be no specific signal which would indicate that the exhauster is entering a surge region.

However, knowing that in such a system the speed of the exhauster will automatically increase as the air flow demand decreases, therefor the exhauster cannot go into surge until after it reaches its maximum speed, which is predetermined based upon the particular application.

Accordingly, by monitoring the exhauster as its maximum speed via the control panel 40 and the power current or frequency, when it drops below a predetermined amount, the control panel 40 signals the purge valve 28 to open and admit air to the exhauster 26 to prevent further reduction of air flow, thus preventing the exhauster 26 from going into surge.

For example, if the exhauster 26 has a maximum speed of 4200 RPM, at approximately 82 hp and below, the exhauster will be in its surge region. Accordingly, the control panel 40 when it senses an exhauster speed of 4200 RPM and monitors a horsepower output of the variable drive xotor 38 such that at $\leqq 80$ hp, it signals the surge valve 28 to permit air to be admitted to the exhauster thereby preventing a further reduction of air flow and the exhauster from going into surge. As the horsepower increases to $\geqq 82$ hp, the control panel signals the surge valve to close. The dead band control region (for example: 80–82 hp) is used to prevent valve "hunting".

The maximum speed will vary upon the particular exhauster involved and applications. The performance curve for the particular maximum speed is readily available from the manufacture. Rotational sensors for monitoring the speed of the exhausters are conventional along with the monitor for the power output of the variable drive engine. Alternatively, the current demand of the motor or frequency can be monitored instead of horsepower.

Thus the several aforenoted objects and advantages of the present invention are most effectively realized and although a preferred embodiment has been disclosed and described in detail herein, it should be understood that the invention is in no sense limited thereby and its scope is to be determined by that of the appended claims.

What is claimed is:

1. In a surge control system for dewatering press felts on a papermaking machine comprising: a suction pipe, a variable speed drive motor, a centrifugal exhauster driven by the variable speed drive motor and connected to the suction pipe to provide vacuum to a felt passing over a slot for dewatering thereof, and whereby as the felt permeability and air flow demand decrease the drive motor increases the speed of the centrifugal exhauster up to a predetermined maximum speed, the improvement comprising: control means coupled to the centrifugal exhauster, said control means for controlling the speed of said exhauster, preventing said exhauster from going into surge prior to reaching the predetermined maximum speed and determining when the predetermined maximum speed occurs, said control means coupled to said drive motor for monitoring when a predetermined load on the drive motor occurs at which the centrifugal exhauster when operating at maximum speed will surge, surge valve for admitting air to the centrifugal exhauster, and said control means coupled to said surge valve and operative in signalling said valve to admit air to the centrifugal exhauster when said centrifugal exhauster is operating at the predetermined maximum speed and the drive motor has predetermined load thereon so as to prevent the centrifugal exhauster from going into surge.

2. The invention in accordance with claim 1 wherein the felt is a papermaker's press fabric.

3. The invention in accordance with claim 1 wherein said variable speed drive motor is an AC motor and said control means monitors the load thereon by monitoring current demand, frequency or horsepower of the motor.

4. In a method of controlling surge in a papermaking machine for dewatering press felts which includes a suction pipe, a surge valve, a variable speed drive motor, a centrifugal exhauster driven by the variable speed drive motor and connected to the suction pipe to provide vacuum to a felt passing over a slot for dewatering thereof, and whereby as the felt permeability and air flow demand decrease, the drive motor increases the speed of the centrifugal exhauster, the improvement steps comprising: limiting the speed of the exhauster to a predetermined maximum speed; preventing said exhauster from going into surge prior to reaching said predetermined speed; determining when the predetermined maximum speed of the centrifugal exhauster occurs; monitoring when a predetermined load on the drive motor occurs at which the centrifugal exhauster when operating at maximum speed will surge; and opening the surge valve to admit air to the centrifugal exhauster when said centrifugal exhauster is operating at the predetermined maximum speed and the drive motor has a predetermined load thereon so as to prevent the centrifugal exhauster from going into surge.

5. The method in accordance with claim 4 which includes the steps of providing an AC motor as the drive motor and monitoring the load thereon by monitoring currend demand, frequency or horsepower of the drive motor.

* * * * *

UNITED STATES PATENT AND TRADEMARK OFFICE

CERTIFICATE OF CORRECTION

PATENT NO. : 4,753,711

DATED : June 28, 1988

INVENTOR(S) : Joseph A. Bolton & Phillip L. Adamczyk

It is certified that error appears in the above-identified patent and that said Letters Patent is hereby corrected as shown below:

Column 1, line 15 after "a" insert--centrifugal exhauster such as that utilized in dewatering--

Signed and Sealed this

Third Day of January, 1989

*Attest:*

DONALD J. QUIGG

*Attesting Officer*

*Commissioner of Patents and Trademarks*